US009739158B2

(12) United States Patent
Rivers et al.

(10) Patent No.: US 9,739,158 B2
(45) Date of Patent: Aug. 22, 2017

(54) ATTACHMENT FEATURE OF A GAS TURBINE ENGINE BLADE HAVING A CURVED PROFILE

(71) Applicant: Rolls-Royce Corporation, Indinapolis, IN (US)

(72) Inventors: Jonathan M. Rivers, Indianapolis, IN (US); Bronwyn Powers, Brownsburg, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 776 days.

(21) Appl. No.: 14/097,865

(22) Filed: Dec. 5, 2013

(65) Prior Publication Data

US 2014/0255187 A1 Sep. 11, 2014

Related U.S. Application Data

(60) Provisional application No. 61/775,640, filed on Mar. 10, 2013.

(51) Int. Cl.
*F01D 5/30* (2006.01)
*F01D 5/14* (2006.01)

(52) U.S. Cl.
CPC ..... *F01D 5/30* (2013.01); *F01D 5/14* (2013.01); *F01D 5/3007* (2013.01)

(58) Field of Classification Search
CPC ..... F01D 5/3007
See application file for complete search history.

(56) References Cited

U.S. PATENT DOCUMENTS

| | | | | |
|---|---|---|---|---|
| 2,794,924 | A | 3/1961 | Rankin et al. | |
| 3,378,230 | A * | 4/1968 | Toomey | F01D 5/3007 416/219 R |
| 3,986,793 | A | 10/1976 | Warner et al. | |
| 4,767,275 | A | 8/1988 | Brown | |
| 5,067,876 | A * | 11/1991 | Moreman, III | F01D 5/3007 416/219 R |
| 5,567,116 | A | 10/1996 | Bourcier | |
| 5,913,660 | A * | 6/1999 | Knott | F01D 5/30 416/219 R |
| 6,739,837 | B2 | 5/2004 | Barnette et al. | |
| 7,300,253 | B2 | 11/2007 | Beeck et al. | |
| 7,467,922 | B2 | 12/2008 | Beeck et al. | |

(Continued)

FOREIGN PATENT DOCUMENTS

GB 808837 A * 2/1959 ..... F01D 5/187

OTHER PUBLICATIONS

International Search Report and Written Opinion for International Application No. PCT/US2013/073279, Aug. 13, 2014, 9 pages.

*Primary Examiner* — Justin Seabe
(74) *Attorney, Agent, or Firm* — Barnes & Thornburg LLP

(57) ABSTRACT

An airfoil member is disclosed having an attachment feature such as a fir tree or dovetail design that includes a curved profile formed from a combination of curves. In one embodiment, the curved profile can be a compound curve formed by a forward curve and a rearward curve that are joined at a point of common tangency. In another embodiment, the curved profile can include curves that do not meet at a common tangency. A cut out can be formed in the curved profile. In some forms, the cut out is formed on a pressure face of the attachment feature.

17 Claims, 5 Drawing Sheets

(56) References Cited

U.S. PATENT DOCUMENTS

| | | | |
|---|---|---|---|
| 7,581,932 | B2 | 9/2009 | Coupe et al. |
| 7,704,044 | B1 | 4/2010 | Matheny |
| 2003/0049131 | A1 | 3/2003 | Murakami et al. |
| 2007/0020102 | A1 | 1/2007 | Beeck et al. |
| 2010/0158696 | A1 | 6/2010 | Pandy et al. |
| 2011/0223027 | A1 | 9/2011 | Klinetob et al. |

* cited by examiner

ATTACHMENT FEATURE OF A GAS TURBINE ENGINE BLADE HAVING A CURVED PROFILE

CROSS REFERENCE TO RELATED APPLICATIONS

This application claims priority to and the benefit of U.S. Provisional Patent Application No. 61/775,640, filed 10 Mar. 2013, the disclosure of which is now expressly incorporated herein by reference.

TECHNICAL FIELD

The present disclosure generally relates to gas turbine engine blades. More particularly, but not exclusively, the present disclosure relates to curved attachment features of gas turbine engine blades.

BACKGROUND

Providing attachment features of gas turbine engine blades useful to accommodate loadings during operation of the gas turbine engine remains the area of interest. Some existing systems have various shortcomings relative to certain applications. Accordingly, there remains a need for further contributions in this area of technology.

SUMMARY

One embodiment of the present disclosure is a unique gas turbine engine attachment feature. Other embodiments include apparatuses, systems, devices, hardware, methods, and combinations for attaching gas turbine engine blades to gas turbine engine wheels. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
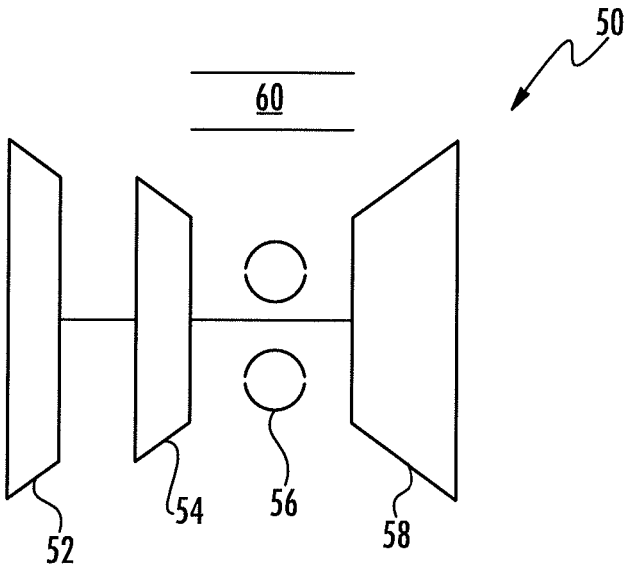
FIG. 1 depicts an embodiment of a gas turbine engine.

For the purposes of promoting an understanding of the principles of the disclosure, reference will now be made to the embodiments illustrated in the drawings and specific language will be used to describe the same. It will nevertheless be understood that no limitation of the scope of the disclosure is thereby intended. Any alterations and further modifications in the described embodiments, and any further applications of the principles of the disclosure as described herein are contemplated as would normally occur to one skilled in the art to which the disclosure relates.

With reference to FIG. 1, one embodiment of a gas turbine engine 50 is depicted which includes a fan 52, compressor 54, combustor 56, and turbine 58. Air is received into and compressed by the compressor 54 prior to being delivered to the combustor 56 where it is mixed with fuel and burned. A flow of air and products of combustion is then delivered to the turbine 58 which expands the flow stream and produces work that is used to drive the compressor 54 as well as to drive the fan 52. The fan 52 is used to develop thrust by accelerating air through a bypass passage 60 which is exhausted out of the rear of the engine 50.

The gas turbine engine can be used to provide power to an aircraft and can take any variety of forms. As used herein, the term "aircraft" includes, but is not limited to, helicopters, airplanes, unmanned space vehicles, fixed wing vehicles, variable wing vehicles, rotary wing vehicles, unmanned combat aerial vehicles, tailless aircraft, hover crafts, and other airborne and/or extraterrestrial (spacecraft) vehicles (e.g. dual stage to orbit platform). Further, the present disclosures are contemplated for utilization in other applications that may not be coupled with an aircraft such as, for example, industrial applications, power generation, pumping sets, naval propulsion, weapon systems, security systems, perimeter defense/security systems, and the like known to one of ordinary skill in the art.

Though the engine 50 is depicted as a single spool engine, other embodiments can include additional spools. The embodiment of the engine 50 depicted in FIG. 1 is in the form of a turbofan engine, but it will be appreciated that some embodiments of the gas turbine engine can take on other forms such as, but not limited to, open rotor, turbojet, turboshaft, and turboprop. In some forms, the gas turbine engine 50 can be a variable cycle and/or adaptive cycle engine.

Figure 2:
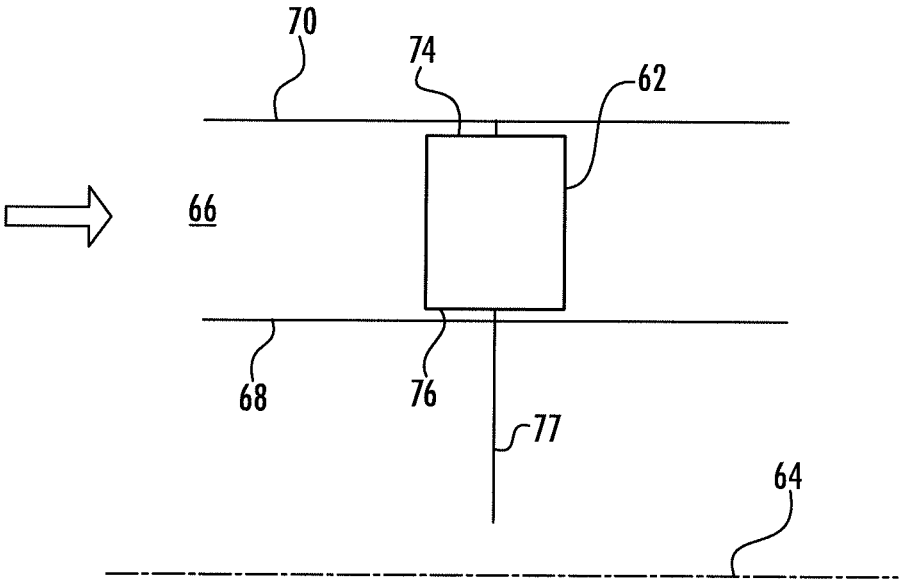
FIG. 2 depicts an embodiment of an airfoil member.

Turning now to FIG. 2, an airfoil member 62 that can be used in the turbomachinery components of the gas turbine engine 50 is depicted. The airfoil member 62 is an airfoil shaped elongate component that extends across a flow path of the turbomachinery component and which can be used to operate upon a fluid traversing the flow path, such as by changing a direction and/or pressure of the fluid travelling through the flow path. The embodiment of the airfoil member 62 depicted in FIG. 2 is in the form of a rotatable blade capable of being rotated around the centerline 64. The airfoil member 62 is disposed in an annular flow path 66 formed between an inner wall 68 and an outer wall 70. The airfoil member includes a tip end 74 disposed adjacent the outer wall 70, and a hub end 76 disposed adjacent the inner wall 68. The hub end can consist of a platform at the base of the airfoil member 62 which rests above an attachment feature such as a dovetail or fir tree design.

The attachment feature, as described further below, is used to couple the airfoil member 62 to a wheel 77 that includes an opening, such as a slide, that can be shaped in the common fashion to receive the dovetail or fir tree design. As used herein, the term "wheel" represents a component structured to receive and retain bladed components having blade root attachments, and can variously be referred to as a rotor, disk, or wheel. The term "wheel" thus encompasses a number of variations and non limitation is intended that the term "wheel" is to be limited to any particular variation unless specifically stated to the contrary.

Figure 3:
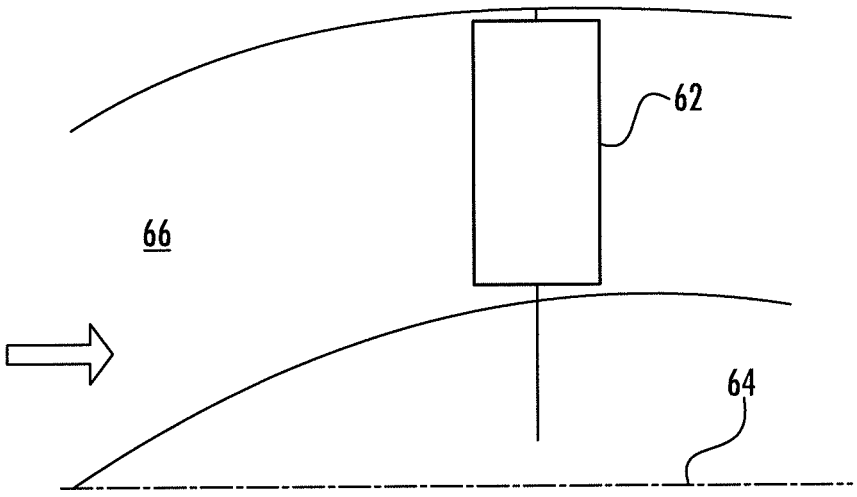
FIG. 3 depicts an embodiment of a gas turbine engine having an airfoil member.

Turning now to FIG. 3, one embodiment of the airfoil member is shown as a fan blade 62 rotatable about the centerline 64. The flow path 66 is bounded by a hub that generally extends away from the centerline 64 at an upstream end until reaching an apex before descending towards the centerline 64. The fan blade 62 is depicted as being located near an apex of the hub, but in other forms the fan blade 62 can be located further forward on the hub or further aft.

Figure 4:
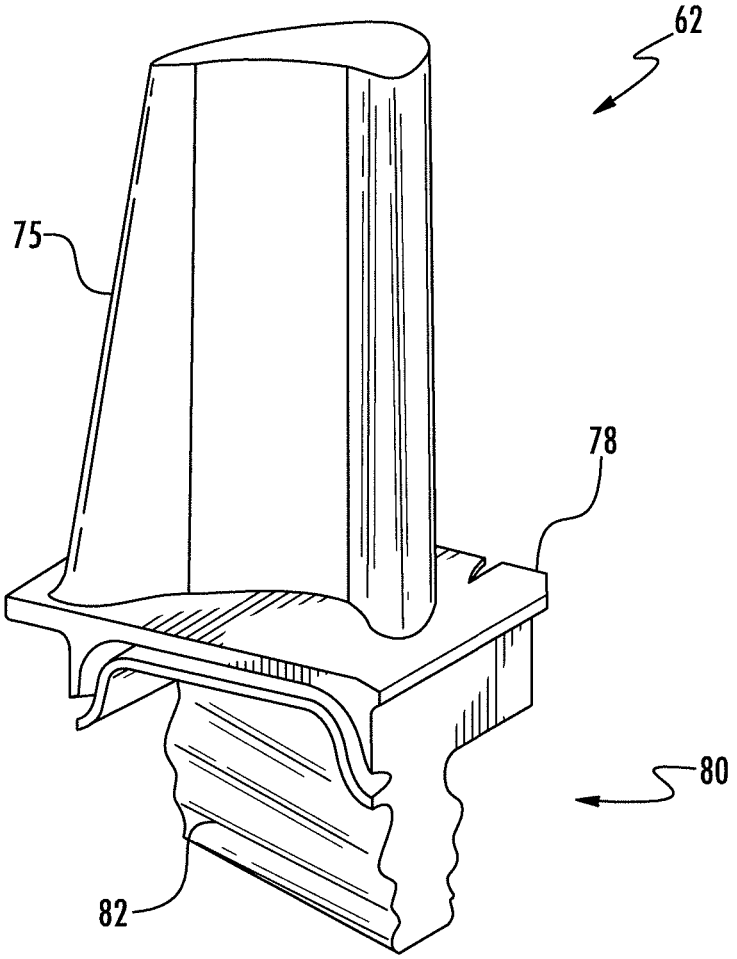
FIG. 4 depicts an embodiment of an airfoil member.

FIG. 4 depicts one embodiment of the airfoil member 62 in the form of the fan blade. The fan blade 62 includes an airfoil section 75, platform 78, and attachment feature 80 which in the illustrated embodiment takes the form of a fir tree design. It will be appreciated that in alternative embodiments the fan blade 62 can use a dovetail design as the attachment feature 80, among other types of attachment feature.

From a perspective view located below the airfoil member 62 and looking upward, the attachment feature 80 includes a curved profile 82 best seen in FIG. 5. In another embodiment shown in FIG. 6, the attachment feature is formed through a combination of a plurality of curves. The plurality of curves used in the attachment feature 80 permits for a more balanced slot stresses fore and aft while in some cases maintaining stiffness. Given that the airfoil member 62 is viewed from a perspective from below the airfoil member 62, it will be appreciated that the curved profile is a characteristic of a lateral side or edge of the attachment features 80 and that the curved profile of the lateral side or edge is arranged in the circumferential direction to form a variable skew angle. The attachment feature 80 generally includes other curved features that are associated with various embodiments, such as curved features in parent in a fir tree or dovetail design. Thus, the curved profile of the lateral side or edge of the attachment feature 80 is separate from the radially extending lobed feature of certain embodiments such as the lobed features in a fir tree or dovetail design.

Figure 5:
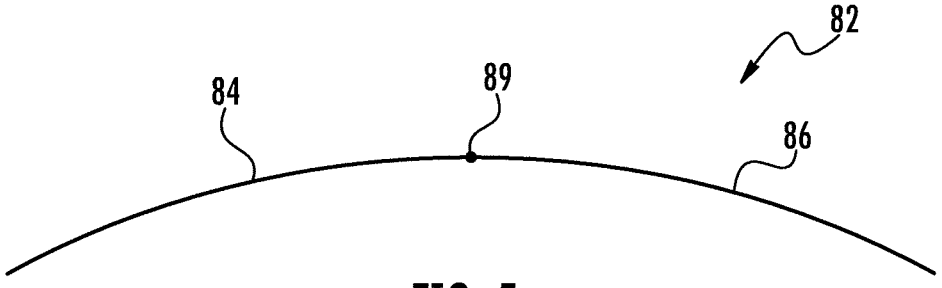
FIG. 5 depicts an embodiment of a curved profile of an attachment feature.

The curved profile 82 illustrated in the embodiment depicted in FIG. 5 includes a forward curve 84 having a constant forward radius and a rearward curve 86 having a constant rearward radius. The forward curve 84 and the rearward curve 86 meet at point 89 which represents a common tendency between the forward curve 84 and rearward curve 86. The arc length of forward curve 84 can be the same or different as the arc length of rearward curve 86.

Figure 6:
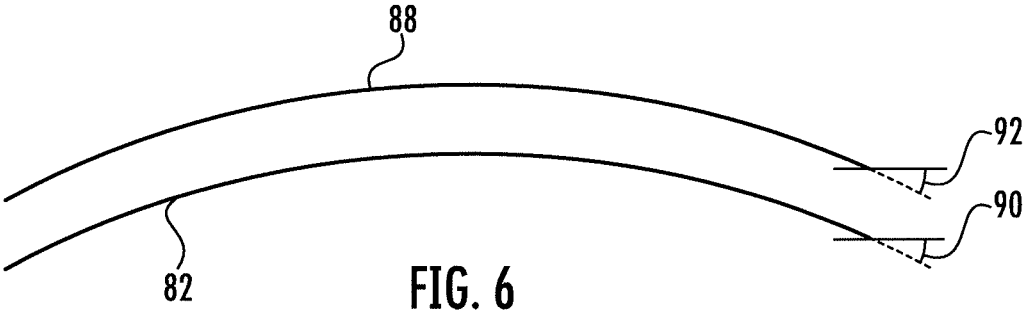
FIG. 6 depicts a comparison between a curved profile and a profile of constant radius.

FIG. 6 depicts a comparison between the curved profile 82 depicted in FIG. 5 with a curve of constant arc radius shown as reference numeral 88. The curve 88 of constant arc radius is depicted as an average between the arc radius of forward curve 84 and the arc radius of rearward curve 86. The compound curve of the illustrated embodiment produces a tighter curvature than the average constant arc radius of curve 88. Furthermore, an entrance angle 90 associated with curved profile 82 can be less than an entrance angle 92 associated with the curve 88 of constant arc radius depending upon the relative orientation of the forward curve 84 and rearward curve 86. In the illustrated embodiment, the entrance angle 90 is less than the entrance angle 92. In any event, and entrance angle and an exit angle of curved profile 82 can be different.

Figure 7:
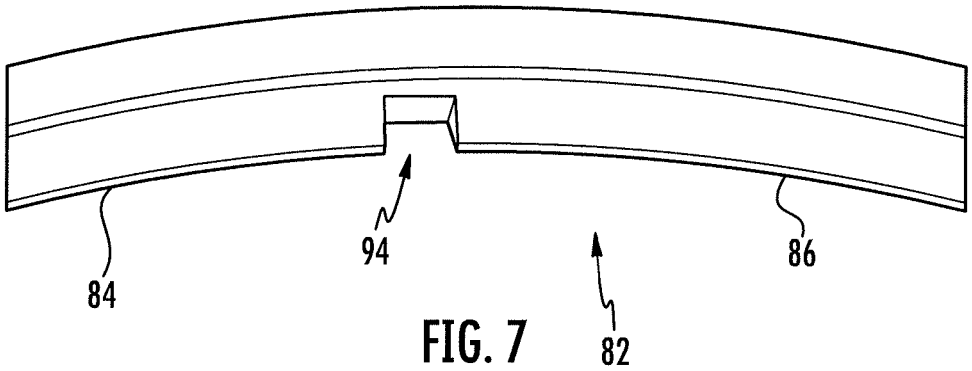
FIG. 7 depicts an embodiment of an attachment feature having a cut out.

The embodiment depicted in FIG. 5 illustrates a compound curvature having curves made up of a plurality of arc segment radii that are joined at tangencies, but as will be described further below, other combinations of curves can also be used such as such as non-tangent curves. Turning now to FIG. 7, the curved profile 82 includes the forward curve 84 and a rearward curve 86 that intersect at a cut out 94 formed in the attachment feature 80. The curves 84 and 86 are configured such that they do not meet at a common tangency as shown above in FIG. 5. The cut out 94 is formed in proximity to the discontinuity in the intersection between the forward curve 84 and rearward curve 86. In some forms, a cut out 94 can be formed such that equal amounts of an opening defined as the cut out 94 on either side of a point of discontinuity. The cut out 94 can be biased toward one or the other of the curves 84 or 86 such that the point of discontinuity is not in the center of the opening of the cut out 94. In one form, an edge of the opening of cut out 94 can be at or near the point of discontinuity.

In one form, the curved profile 82 is formed in a pressure face of the attachment feature 80 such that the cut out 94 is used to break up a pressure flank this batch that would otherwise lead to increased local crushing stresses and where at the curved mismatch location. However it will be appreciated that the curved profile 82 can be formed in locations other than associated with a pressure face of the attachment feature 80. The cut out 94 is depicted as a squared off cutouts but different geometries can be used for the cut out 94 in other embodiments. For example, a cut out having curved faces and/or a combination of faceted in curved features can be used to, among other shapes and combinations.

Figure 8:
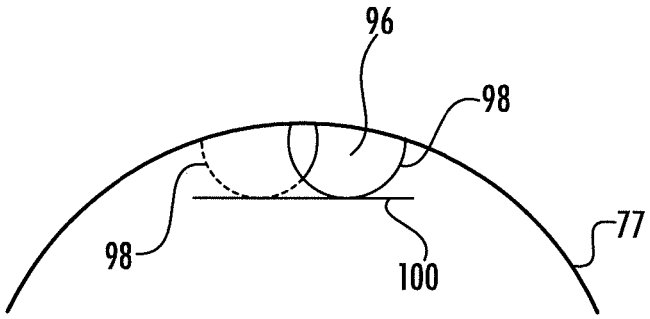
FIG. 8 depicts an embodiment of a wheel having an opening sized to receive an attachment feature of an airfoil member.

The curved profile 82 can be located in a plane and a corresponding opening in the wheel 77 can be formed having a shape having a reciprocal planar constraint. For example, turning now to FIG. 8, the wheel 77 is shown having an opening 96 defined by a wall 98. The solid line associated with wall 98 depicts a forward in closest to the viewer, and the dashed line 98 represents the wall at an opposite end of the wheel 77 where it is understood that the dashed line indicates a surface that is hidden from view. A plane 100 illustrates a reciprocal planar nature of the opening 96 shaped to receive the attachment feature 80 of the airfoil member 62.

While the invention has been illustrated and described in detail in the drawings and foregoing description, the same is to be considered as illustrative and not restrictive in character, it being understood that only the preferred embodiments have been shown and described and that all changes and modifications that come within the spirit of the disclosures are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the disclosure, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A gas turbine engine blade comprising an airfoil member structured to change a pressure of a working fluid when installed and operated within a gas turbine engine, and a circumferentially curved root attachment structured to be slidingly received within a slot formed in a wheel of a gas turbine engine, the circumferentially curved root attachment having a curvature on a side of the curved root attachment defined by a plurality of curves and characterized by a first curvature having an arc length with a constant forward radius in an axially forward portion of the curved root attachment and a second curvature having an arc length with a constant rearward radius in an axially rearward portion of the curved root attachment, the first curvature different than the second curvature.

2. The gas turbine engine blade of claim 1, wherein the curved root attachment is one of a dovetail and a fir tree.

3. The gas turbine engine blade of claim 2, wherein the first curvature meets the second curvature at a common tangency point.

4. The gas turbine engine blade of claim 1, wherein the first curvature meets the second curvature at a non-tangency.

5. The gas turbine engine blade of claim 4, which further includes an opening formed in the gas turbine engine blade at an intersection of the first curvature and the second curvature.

6. The gas turbine engine blade of claim 1, wherein the curved root attachment includes a lobed feature.

7. The gas turbine engine blade of claim 1, wherein an entrance angle of the curved root at a forward end of the gas turbine engine blade is different from an exit angle of the curved root at an aft end of the gas turbine engine blade.

8. A gas turbine engine blade comprising a root section structured to be secured by a reciprocal opening formed in a gas turbine engine wheel, wherein the root section is curved in a circumferential direction and includes a variable radius of curvature in the circumferential direction, and wherein a length of a first portion of the variable radius of curvature is located on a side of the gas turbine engine blade and includes a constant center of curvature that is different than a constant center of curvature of a length of a second portion of the variable radius of curvature located on the same side of the gas turbine engine blade as the first portion.

9. The gas turbine engine blade of claim 8, wherein the root section includes a lobed feature that prohibits radial removal of the gas turbine engine blade from a gas turbine engine wheel when mounted.

10. The gas turbine engine blade of claim 9, wherein the lobed feature is a dovetail.

11. The gas turbine engine blade of claim 8, wherein the first portion meets the second portion at a common tangency.

12. The gas turbine engine blade of claim 8, wherein the first portion merges with the second portion at a discontinuity.

13. The gas turbine engine blade of claim 12, which further includes an opening formed in the blade in proximity to the discontinuity.

14. A method comprising providing a gas turbine engine wheel having a curved slot structured to retain a blade root, orienting a gas turbine engine blade having the blade root relative to the gas turbine engine wheel, the blade root having a lateral side defined by a circumferentially extending skew curvature that includes a plurality of curves, the circumferentially extending skew curvature forming a variable skew angle relative to the centerline of the gas turbine engine wheel between a first portion having an arc length with a first constant radius and a second portion having an arc length with a second constant radius, the first constant radius being different than the second constant radius, wherein the first and second portion are located on the lateral side, and slidingly coupling the blade root with the curved slot.

15. The method of claim 14, which further includes forming an entrance angle of the lateral side of the blade that is different than an exit angle of the lateral side.

16. The method of claim 15, wherein the circumferentially extending skew curvature includes a first curvature defined by the first constant radius that meets a second curvature defined by the second constant radius at a point of tangency.

17. The method of claim 15, wherein the slidingly coupling results in the insertion of lobed attachment defined by the blade root into the curved slot.

* * * * *